US005467973A

United States Patent [19]

Graushar et al.

[11] Patent Number: 5,467,973

[45] Date of Patent: Nov. 21, 1995

[54] APPARATUS AND METHOD FOR ADDRESSING VARIABLE THICKNESS SIGNATURES

[75] Inventors: William T. Graushar, Wauwatosa; John C. Geres, West Allis; Todd J. Dettmering, Menomonee Falls, all of Wis.

[73] Assignee: Quad/Tech, Inc., Sussex, Wis.

[21] Appl. No.: 51,067

[22] Filed: Apr. 21, 1993

[51] Int. Cl.[6] ..... B41F 13/54

[52] U.S. Cl. ..... 270/1.1; 270/58

[58] Field of Search ..... 27/54, 55, 1.1, 27/58

[56] References Cited

U.S. PATENT DOCUMENTS 3,819,173 6/1974 Anderson et al. ..... 270/1.1 X
4,121,818 10/1978 Riley et al. ..... 270/54
4,167,476 9/1979 Jackson ..... 414/789.9 X
4,302,198 11/1981 Kawada ..... 270/58 X
4,984,948 1/1991 Lindsay et al. ..... 270/54 X
5,294,100 3/1994 Scheibelhut ..... 270/54

*Primary Examiner*—John E. Ryznic
*Attorney, Agent, or Firm*—Michael, Best & Friedrich

[57] ABSTRACT

A system having a printer for customizing signatures delivered and processed on a conveyor line in groups of completed books of variable thickness includes an arrangement for maintaining a constant distance between the printer and the books regardless of the thickness of the books in order to preserve the quality of printing on the books. The system further includes an arrangement for selectively diverting completed books to a stacker, a mail stream conveyor and a poor quality book conveyor.

12 Claims, 7 Drawing Sheets

APPARATUS AND METHOD FOR ADDRESSING VARIABLE THICKNESS SIGNATURES

TECHNICAL FIELD

The present invention relates generally to an apparatus and method for printing signatures assembled into booklet or magazine form and, more particularly, pertains to an apparatus and method for addressing assembled signatures of variable thickness.

BACKGROUND OF THE INVENTION

Collating and binding systems for saddle stitchers are well known in the printing industry for mass producing booklets, catalogues, magazines and the like. Typically, one or more sharply folded and generally pre-printed blanks or signatures are selectively and sequentially fed by a number of spaced signature feeders. The signatures are delivered such that the folded margins or spines of the signatures come to rest upon a collating conveyor line or chain which travels past the signature feeders. The conveyor gathers the signatures, one on top of the other, and moves them through one or more on-line printing stations to a stitching or binding station. The assembled signatures are then usually diverted to a trimming station and further led to an addressing station where mailing information is applied. Thereafter, the assembled and addressed signatures are sorted, bundled and readied for mailing or distribution.

Prior art systems of this type contemplate the computer controlled production of various demographic editions of books or catalogues of internal and external signatures containing individually tailored information or customized printing on selected signatures. In providing these demographic versions, the prior art commonly employs an information source which indicates the special interest of each subscriber within a common postal locale. Based on the information source, a controller selectively actuates the signature feeders to deliver certain signatures upon the conveyor to form one or more individualized editions of a booklet or magazine for each subscriber within the zip code area. Information in the source is generally arranged in sequential order so that the formed booklets or magazines leave the conveyor ready to be sorted into groups which qualify for postal discounts. As part of this collation process, the signatures are conveyed past one or more customizing stations typically employing ink jet printing for applying personalized data.

Ink jet printing is a non-contact marking method wherein the only element touching the material or substrate to be marked is the printing ink. The process is ideal for printing on a variety of materials at high speeds. The most important portion of the ink jet printer is the print head which is supplied with a special ink pumped from a reservoir. The ink emerges from a nozzle on the head as a stream of tiny drops of equal size broken up by ultrasonic oscillation. As the drops are formed, they pass through a charging electrode and collect a variable electrostatic charge as desired. The size of the desired charge determines the position of the drops on the substrate because they then pass through a high voltage field. This field causes each droplet to be deflected sideways by an amount proportional to the size of the desired charge. The print head produces characters from a single line of drops. Moving the substrate at right angles to their plane of deflection produces lines of characters in a dot matrix pattern. As long as the print head is disposed at the correct distance from the substrate, the ink droplets will properly deflect and yield a quality printing result. This requirement becomes even more important as the ink jet printer is called upon to deliver certain types of printing, such as bar coding, which demand meticulous accuracy in the formation of minuscule bars and half bars as used for addressing purposes in qualifying for postal discounts.

It is desirable that magazines be processed and addressed to take advantage of maximum postal discounts. For example, sorting magazines into carrier route bundles is the most cost effective method of mailing in order to qualify for the lowest possible postal rate. All remaining magazines not sorted into carrier bundles are eligible for bar code discounts as long as the address information on them is complete and accurate. In this regard, it would be advantageous if a plurality of magazines could be assembled and selectively addressed during a given production run to attain the optimum postal rate available for each sequential magazine.

Prior art systems have been lacking because of inflexibility. For instance, systems currently employed do not possess the most efficient sorting capability at their mail tables or addressing station since completed books are routed either to a reject conveyor or a stacker. There is no special provision to more perfectly sort those addressed magazines so that they can meet minimum bundle specifications for a given postal locale and still get the most favorable postal rate. Additional techniques for improving sortation options need to be considered.

Accordingly, it is desirable that the demographic bindery system offer a greater degree of customization, improving upon the print quality of assembled and addressed books and magazines of variable thickness and allowing a better sortation of assembled and addressed books and magazines to obtain optimal postal discounts.

SUMMARY OF THE INVENTION

The present invention advantageously provides an improved addressing and sortation capability for the high speed collating and binding of books of signatures. The improved processing system provides noteworthy versatility, and is readily adaptable into existing systems with a minimum of modification.

These and other advantages are realized in one aspect of the invention by a signature customizing system having a plurality of feeders for selectively delivering and processing signatures on a conveyor line in groups of completed books of variable thickness. A printer is located adjacent the conveyor for printing information on the books. A compensation mechanism is operatively connected with the conveyor line for maintaining a constant distance between the printer and the books regardless of the variable thickness of the books in order to preserve the quality of the printing on the books.

The invention also contemplates a method of customizing signatures in a system having a plurality of feeders for delivering signatures in groups of completed books of variable thickness to a conveyor line where books are printed by a printer. The method includes the step of maintaining a constant distance between the books and the printer regardless of the variable thickness of the books.

In a highly preferred embodiment, the customizing system includes a stacking mechanism operatively connected with the conveyor line for selectively receiving a first type of book suitable for distribution. The system also has a mail stream conveyor operatively connected with the conveyor line for selectively receiving a second type of book suitable for distribution. In addition,there is a poor quality book conveyor operatively connected with the conveyor line for selectively receiving books unsuitable for distribution. A selection mechanism is utilized to selectively divert books among the stacking mechanism, the mail stream conveyor and the poor quality book conveyor.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE

Figure 1:
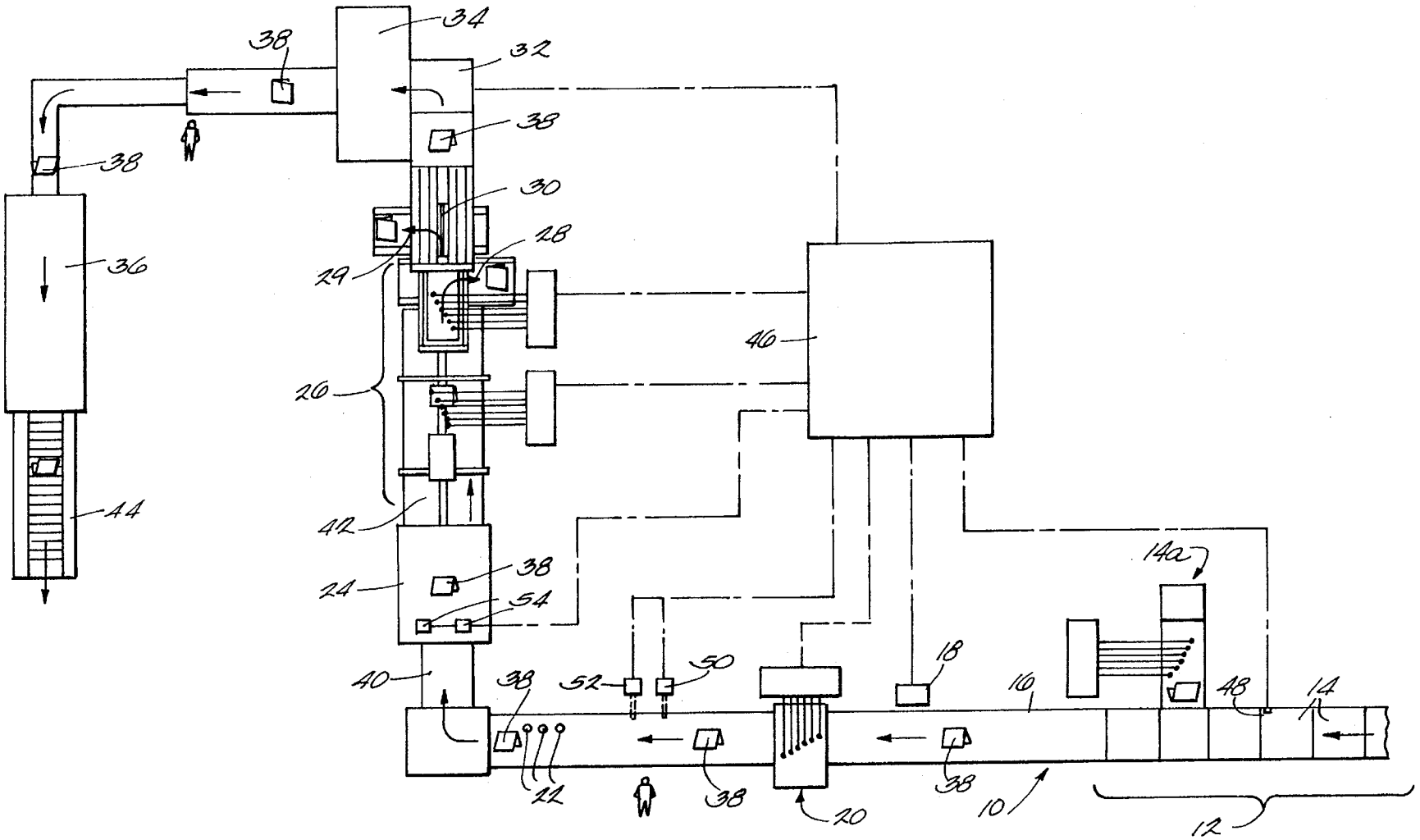
FIG. 1 is schematic block diagram of a signature customizing system employing the present invention.

Referring to FIG. 1, a collation and binding (conveyor) line 10 for a saddle stitcher encompassed by the present invention is employed to produce various magazines, catalogues, brochures, periodicals, etc. containing different collections of signatures for different customers or subscribers. Line 10 suitably includes an inserter 12 having a plurality of signature feeders 14, a collating chain(conveyor) 16, a caliper 18, a primary customizing station 20, a stitcher 22, a trimmer 24, an addressing station 26, a stacker 32, a strapper 34, and a wrapper 36.

Each feeder 14 holds a supply of signatures 38 and is designed to selectively deliver a single signature 38 from a supply stack within feeder 14 so that its folded margin or spine falls upon collating chain or conveyor 16. In some instances, it may be desirable to use an auxiliary customizing arrangement 14*a* in order to print personalized information transverse to the spine of signatures 38 before they are delivered to conveyor 16. Such an arrangement is set forth in U.S. Pat. No. 5,100,116 assigned to the assignee of the present application. Collating chain or conveyor 16 collects signatures 38 from signature feeders 14 and transports the signatures downstream for processing along collation and binding line 10. As signatures 38 are gathered, they move past caliper 18 which monitors the appropriate thickness of the book and then travel through customizing station 20, preferably an ink jet printer, which applies personalized information to signatures being collated in a direction parallel to their spines. After the customizing, conveyor 16 pushes the signatures to stitcher 22 where they are bound to create an assembled,completed book such as by stapling or the like.

The completed book is then diverted with its spine leading on a flat conveyor 40 to trimmer 24 where its edges are trimmed and next transported onto another conveyor (mailing table) 42 to addressing station 26 where mailing and other customized information is normally printed or otherwise applied. In the preferred embodiment, a non-contact printer of the well known ink jet type which projects a pattern of ink dots downwardly or upwardly or otherwise bidirectionally is utilized at stations 14*a*,20 and 26. While the preferred embodiment discloses an ink jet printer, it should be appreciated that other non-contact printers, such as laser or ion deposition printers may be utilized. Likewise, other suitable arrangements such as a blow-in card feeder or applique device may be used in conjunction with or in place of a printer as will be appreciated. At addressing station 26, the assembled book is selectively diverted to one of three paths 28,29,30,to be further explained, the latter transporting book to stacker 32, strapper 34, and wrapper 36, where it is readied for mail or other distribution at an exit conveyor 44.

The collating and binding line 10 generally described above is controlled by a conventional computer or programmable controller 46, the details of which are well known in the art. Likewise, inserter 12, caliper 18,primary customizing station 20, stitcher 22, trimmer 24, stacker 32, strapper 34 and wrapper 36 are of conventional construction and do not require a detailed discussion.

Controller 46 is operatively connected to feeders 14 of inserter 12, to primary customizing station 20 and addressing station 26 and provides control signals thereto. Stacker 32 is also coupled to controller 46 so that books will be sorted according to number and weight qualifying for the best postal rate under carrier route sortation as is well understood.

It is common practice that line 10 is monitored for the occurrence of errors as well as for inventory purposes through the collating and binding process. Accordingly, each of feeders 14 carries a sensor 48 in communication with controller 46 for detecting an incorrect feed of a signature 38 within each feeder 14. Likewise, caliper 18 is mounted adjacent conveyor 16 and sends an interrupt signal to controller 46 upon deviation of the collated signatures 38 from a prescribed thickness parameter. In addition, at least one sensor 50 is positioned on line 10 to enable controller 46 to oversee the information applied at primary customizing station 20. An encoder 52 is typically placed adjacent conveyor 16 downstream of customizing station 20 to monitor the position of signatures 38. As is well known, encoder 52 gives an indication of angular or cyclical position, where one rotation corresponds to travel of one book space. Controller 46 is further connected to a short book detector 54 at trimmer 24 to determine the presence of an unacceptably trimmed book. It should be understood that if at any point in the collating and binding process an erroneously prepared book is detected, or if no book is present when one should be present according to controller 46, this indication will be used to inhibit certain subsequent processing on the unsuitable book and reorder the book.

Addressing station 26 and mailing table 42 are generally disposed downstream of trimmer 24, and are adapted to selectively operate upon collated, customized, assembled and trimmed signatures 38 maintained in custody on line 10 in a product slot defined on line 10. As is well known, these product slots are monitored by encoder 52 to keep inventory of the books being formed in accordance with the movement of line 10.

Figure 2:
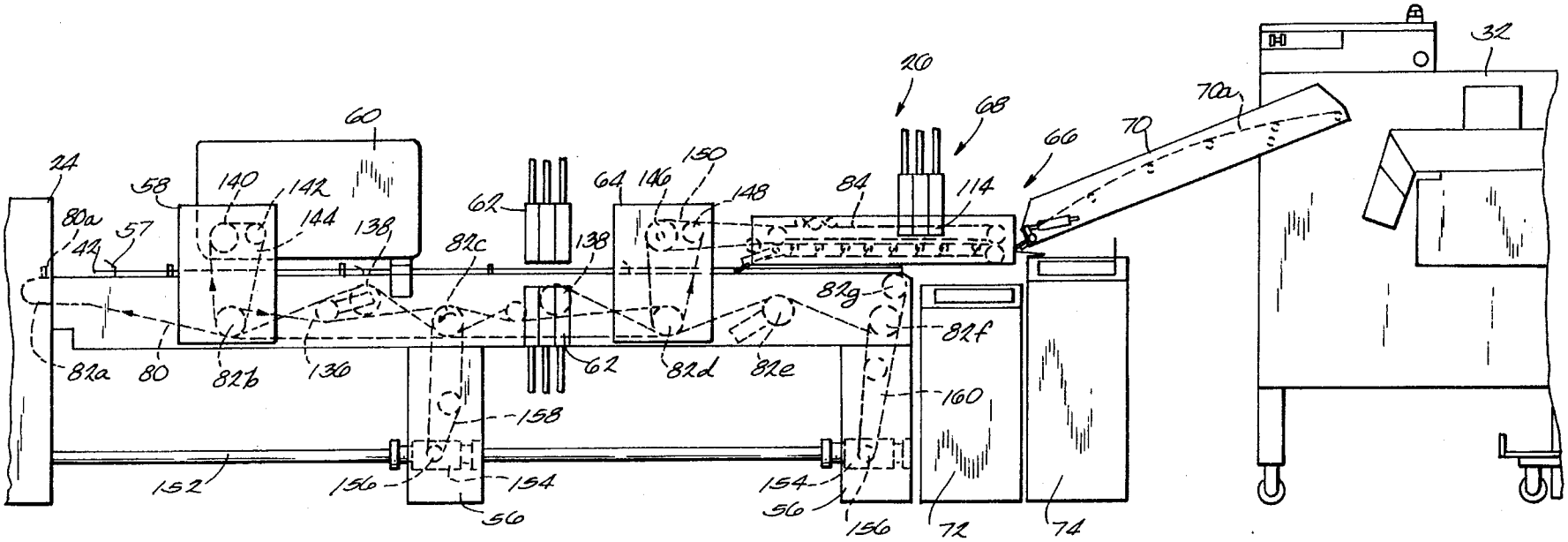
FIG. 2 is a side elevational view of the mail table and addressing stations shown in FIG. 1.
Figure 3:
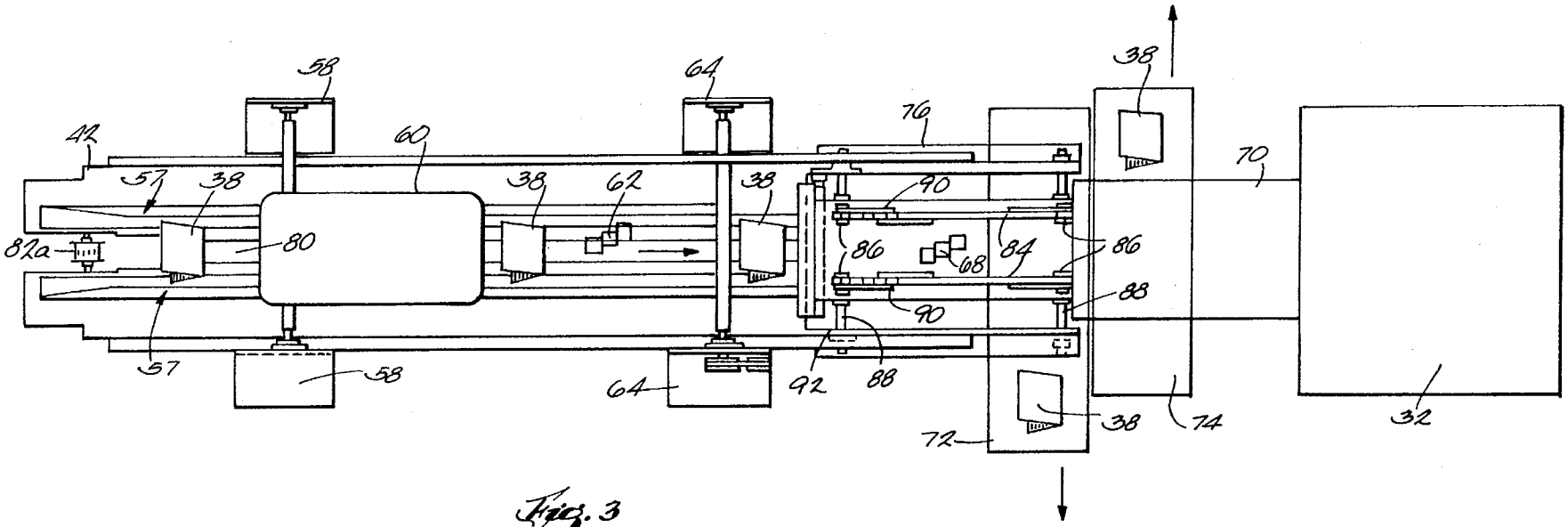
FIG. 3 is a fragmentary top, plan view of the system shown FIG.2.
Figure 4:
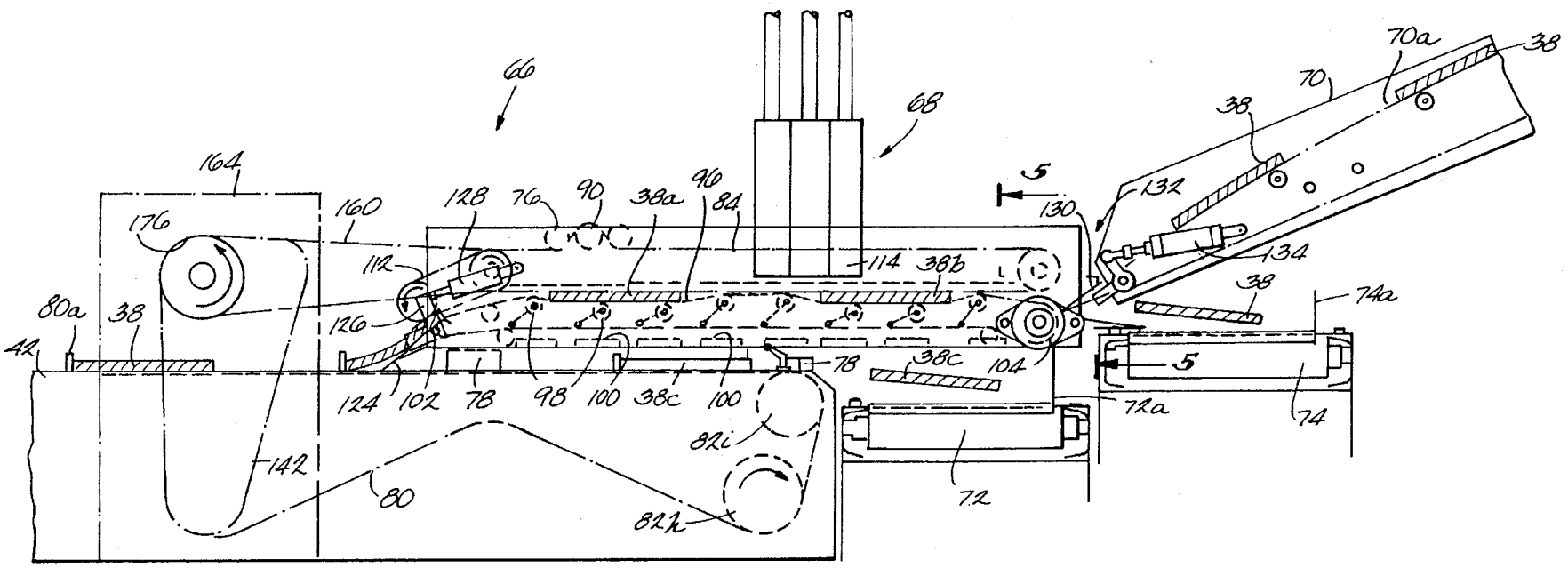
FIG. 4 is an enlarged, fragmentary side view of the compensating mechanism embodied in FIG. 2.
Figure 5:
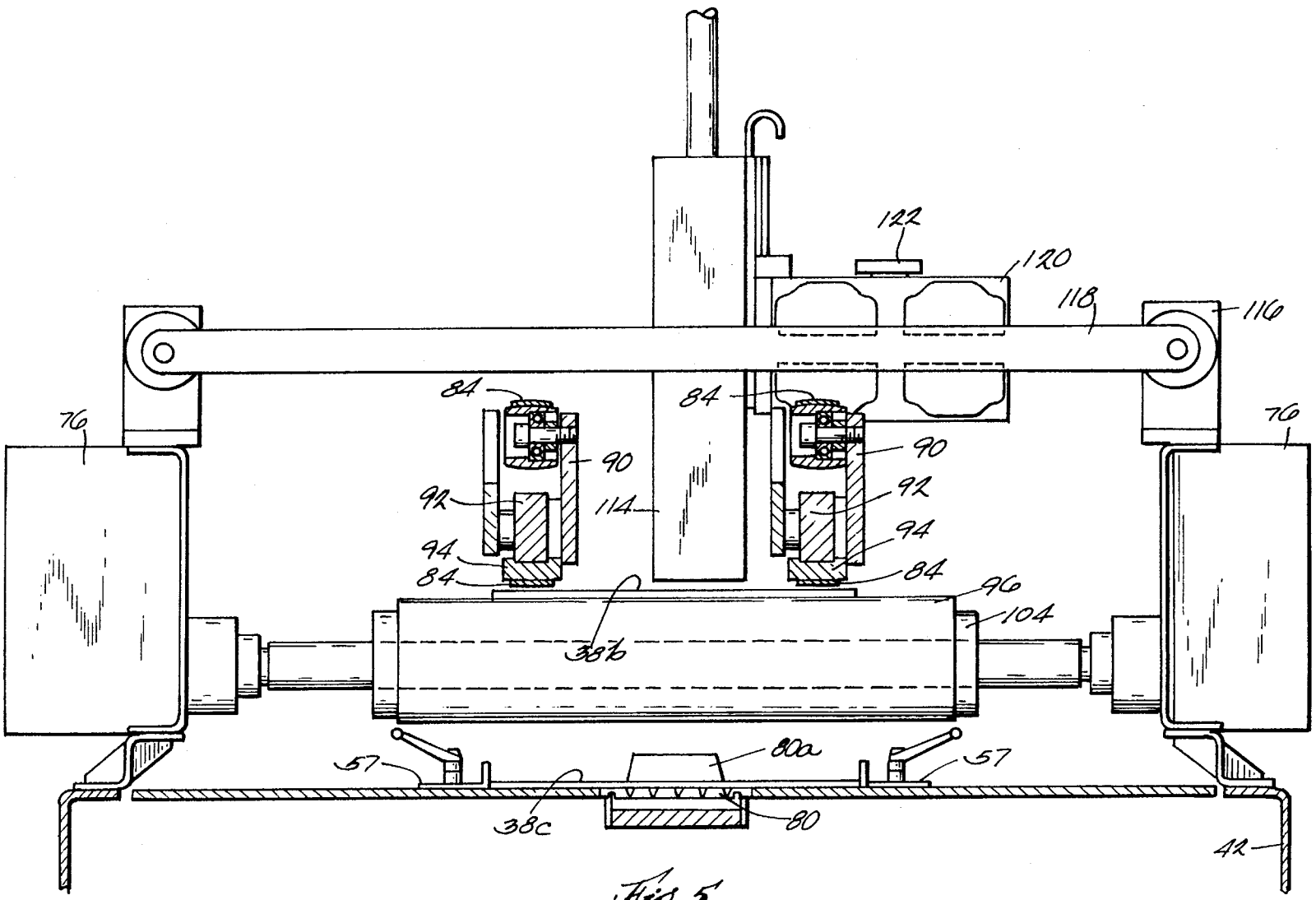
FIG. 5 is a fragmentary end view taken on line 5—5 of FIG. 4.
Figure 6:
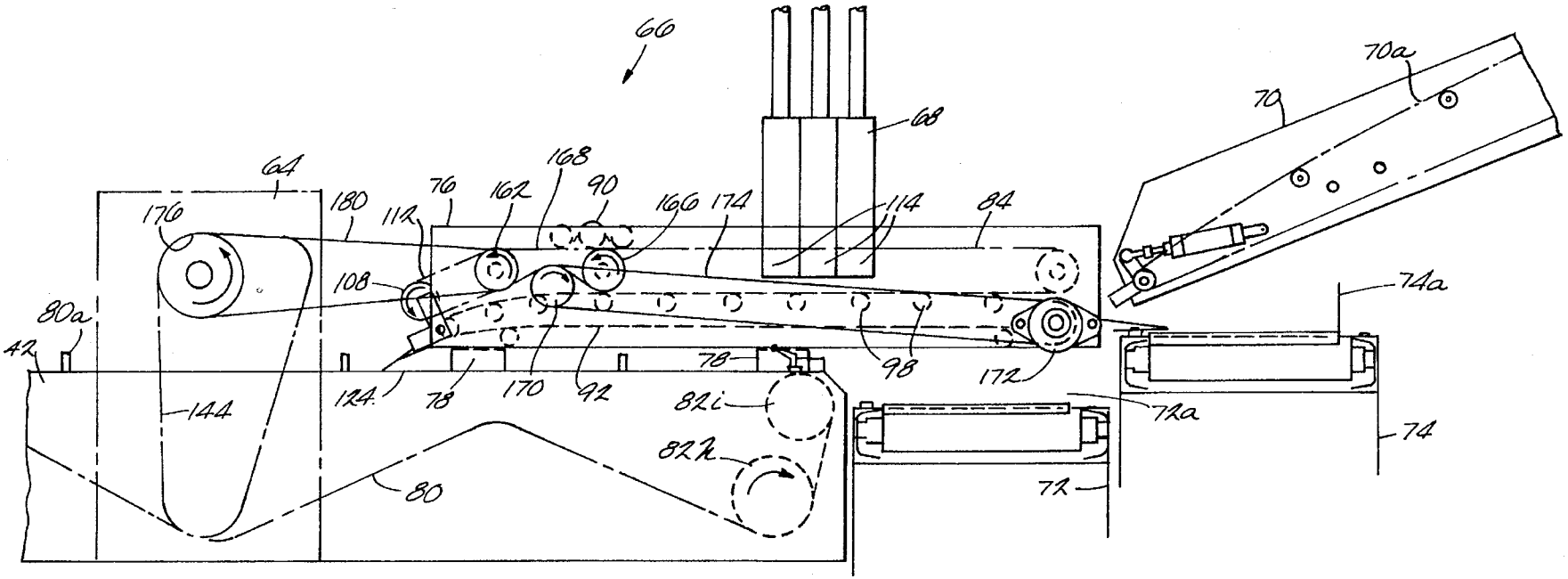
FIG. 6 is a fragmentary side view of the compensating mechanism shown in FIG. 4 emphasizing certain belt drives.
Figure 7:
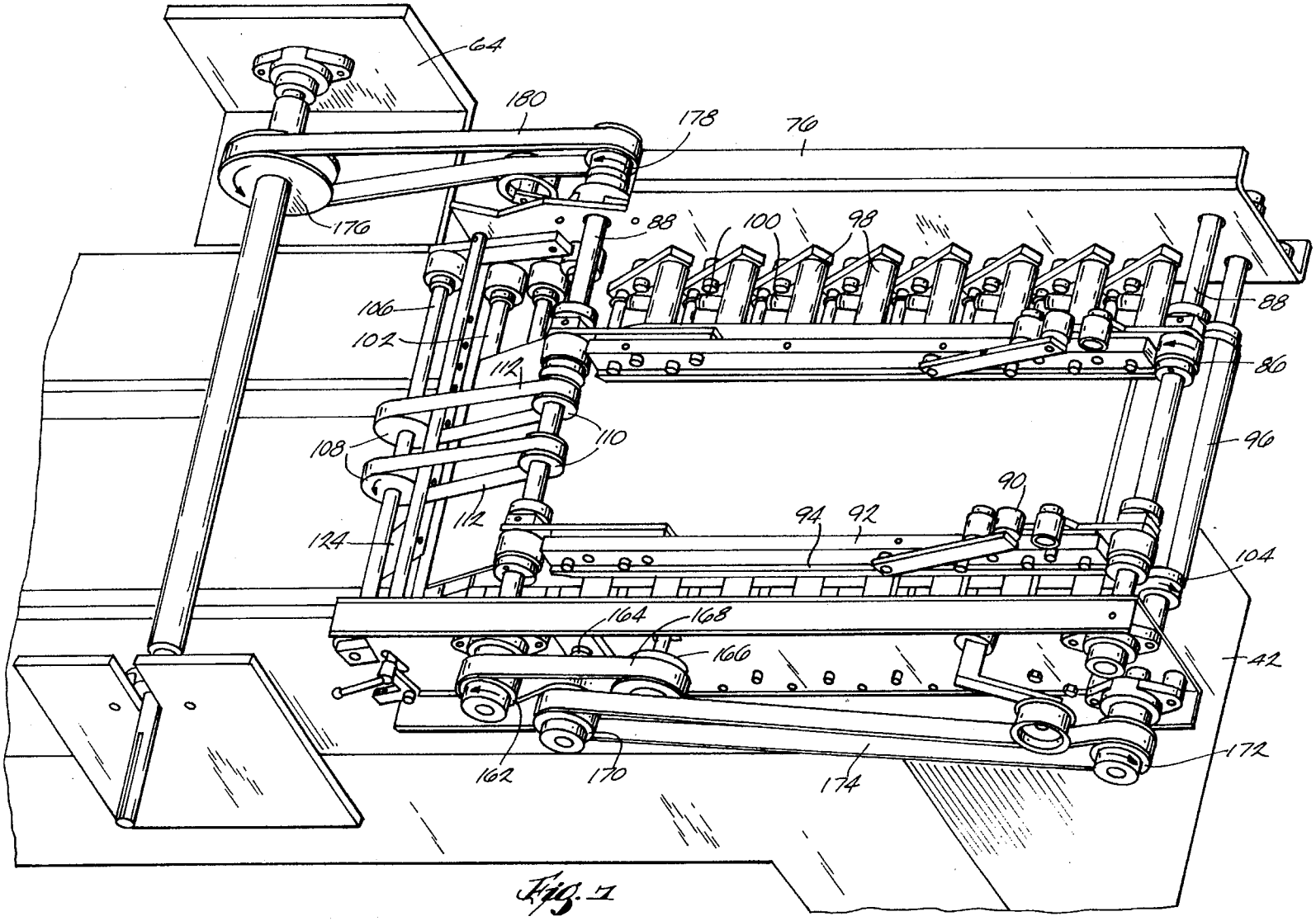
FIG. 7 is a fragmentary, perspective view of the compensating mechanism shown in FIG. 4.

Turning now to FIG. 2, mailing table 42 on conveyor line 10 modified in accordance with the present invention is connected at its upstream end to trimmer 24 and is supported in the middle and at its downstream end by a set of stanchions 56. Table 42 includes adjustable registration guides 57, first label head drives 58, a label head 60, a second customizing station 62,and second label head drives 64, as well as addressing station 26 comprising a compensation mechanism (book leveller) 66 and an ink jet printer 68. An inclined ramp conveyor 70 having a moving belt 70*a* connects the downstream end of table 42 to stacker 32. Also at the downstream end of table 42 are located a poor quality(reject)conveyor 72 having a stop wall 72*a* for selectively receiving books unsuitable for distribution and a mail stream conveyor 74 having a stop wall 74*a* for selectively receiving one type of books suitable for distribution as will hereafter be explained. In order to push books from trimmer 24, an endless belt conveyor 80 provided with pushing lugs 80*a* runs medially of and substantially the length of table 42 and is wound about a tortuous path defined by a series of sprockets 82*a*–82*g* mounted on corresponding shafts under table 42.

As seen in FIGS. 3–7, compensating mechanism 66 includes a frame 76 which is straddled across the width and spaced from the top of table 42 by a set of supports 78. A pair of upper delivery belts 84 are entrained around a set of laterally shiftable rollers 86 positioned along a respective set of shafts 88. Each belt 84 may be suitably tightened or loosened using a movable tensioning mechanism 90. An elongated bar 92 and wear strip 94 bear against the lower run of each lower belt 84 and form a registration plane against which a book is biased as will be understood. A single lower delivery belt 96 is wrapped about a series of parallel, spaced movable rollers 98 biased upwardly against upper belts 84 by spring mechanisms 100 anchoring the ends of rollers 98 to bottom of frame 76. Belt 96 is also wound about a roller 102 at its upstream end and about an internal roller 104 mounted on a respective shaft at its downstream end. Shaft 106 carries a pair of rollers 108 which cooperate with rollers 110 on shaft 88 to define a path for a pair of auxiliary delivery belts 112.

A bank of conventional ink jet heads 114 is adjustably mounted on a rack 116 (FIG. 5) to the top of frame 76 so that heads 114 overlie lower belt 96 and sit between(or alternatively outside of )upper belts 84. Ink jet heads 114 are ultimately controlled by computer 46 and function to print one or two lines per head which include a human readable address and a bar code corresponding to that address. Each head 114 is fixed to a shaft 118 which passes through a mounting block 120 having a locking knob 122 to lock the head in place. A first book selector 124 is preferably a movable gate disposed at the upstream end of compensating mechanism 66. Selector 124 comprises a pivot linkage 126 actuated by a pneumatic cylinder 128 which responds to controller 46. A second book selector 130 having a pivot linkage 132 actuated by a pneumatic cylinder 134 responsive to controller 46 is positioned at the upstream end of conveyor ramp 70.

Referring back to FIG.2, mail head drives 58,64 are operatively connected via a pair of belts 136 which travel around sprockets 82*b*,82*c* and 82*d* as well as tensioning devices 138. Mail head drives 58 carry shaft-mounted sprockets 140 and 142 which together with sprocket 82*b* form a path for an endless belt 144. Likewise, mail head drives 64 are provided with sprockets 146 and 148 which cooperate with sprocket 82*d* to define a path for an endless belt 150.

Certain components of table 42 are driven in synchronism with the drive of trimmer 24 which includes a drive shaft 152 connected to gear reducers 154 having sprockets 156. Endless belts 158, 160 run around sprockets 82*c*,156 and sprockets 82*f*, 156, respectively. As seen best in FIGS. 6–7, compensation mechanism 66 carries sprockets 162,164,166 which form a path for endless belt 168. Mechanism 66 also includes sprockets 170,172 which form a path for an endless belt 174. A sprocket 176 inside mail drive 64 interacts with a sprocket 178 on shaft 88 to define a path for an endless belt 180. With this arrangement, rotation of drive shaft 152 will cause gear reducers 154 to transmit a driving force to belts 158,160 and in turn to belt 136 such that belt 144 will drive mail head 60 and belt 150 will cause cooperating movement of upper belts 84 and lower belt 96.

In operation, completed books 38 of variable thickness exiting from trimmer 24 will be conveyed along table 42 on which a label may be applied to book 38 from label head 60 or on which further personalized information may be printed via second customizing station 62 as dictated by controller 46. At book selector 124, certain books 38 acceptable for distribution are normally diverted to a nip between auxiliary belts 112 and lower belt 96 which transports books 38*a*,38*b* of variable thickness to moving belts 84,96 and under heads 114 so that an address and corresponding bar code are selectively printed on the cover of respective thin and thick books 38*a*,38*b*. Bar coded books 38 which may be bundled to qualify for optimum available postal discounts are subsequently diverted by gate 130 to conveyor belt 70*a* for delivery to stacker 32. Certain other books 38 also suitable for distribution but not meeting bundle specifications will be diverted along path 29 to mail stream conveyor 74 by controller 46 actuating cylinder 134 to raise gate 130. In due course, an operator attending the system will gather a minimum number of books 38 from town sort conveyor 74 for distribution in the postal system. Certain other books 38 deemed unsuitable for distribution as determined by error signals from short book detector 54, will be allowed to continue travel on table 42 by controller 46 actuating cylinder 128 to raise gate 124. At the end of table 42, rejected book 38 is transferred along path 28 to poor quality book conveyor 72 and is later discarded. As is well known, the error signals are utilized to reorder books found defective.

As a salient feature of the invention, it should be understood that compensating mechanism 66 by means of spring-biased or otherwise reactive rollers 98 acts as a book levelling device to ensure that each cover of each book 38 being selectively bar coded regardless of thickness will be pushed upwardly against a common registration plane defined by reinforced belts 84. The effect of this structure is to maintain a constant distance between each head 114 and the cover of each book 38 so as to preserve the quality of the bar code printing.

It should be appreciated that the present invention greatly enhances the flexibility of addressing customized books in a collating and binding system. Such flexibility is attained without losses in productivity and without creating additional problems in handling of books 38. The preferred form of the invention is easily adaptable to existing systems and offers a versatility in efficient handling of signature stocks of various sizes, weights and finishes.

Unlike prior art devices, the present invention provides three discrete paths for channeling completed books in order to obtain the most efficient,complete sortation for mail distribution while maintaining quality control over the bar code printing specifications required by the U.S. Postal Service. By focusing on a modification of the conventional mail table and addressing station, the present invention sets forth an advance which markedly improves customized and addressed signature printing capability.

While the invention has now been described with reference to a preferred embodiment, those skilled in the art will appreciate that certain substitutions, alterations, and omissions may be made without departing from the spirit thereof. For instance, it should be appreciated that it may be desirable to locate compensating mechanism 66 upstream of trimmer 24. It should also be understood that various other drive arrangements may be contemplated to drive components on mail table 42 and book leveller 60. For example, pulleys and other equivalent timing devices may be substituted in place of the aforementioned sprockets or rollers. Also, electric actuators could be used in lieu of the pneumatic cylinders 128,134. Likewise, the invention may be utilized in a collating system where signatures are stacked on top of each other using a flattened conveyor belt. Accordingly, the foregoing description is meant to be exemplary only and should not be deemed limitative on the scope of the invention set forth in the following claims.

We claim:

1. A signature customizing system of the type including a conveyor line, a plurality of feeders for selectively delivering and processing signatures on said conveyor line in groups of completed books of variable thickness, and a printer located adjacent said conveyor for printing information on said books, the system comprising:

compensation means operatively connected with said conveyor line for maintaining a constant distance between said printer and said books regardless of the variable thickness of said books in order to preserve the quality of printing on said books, said compensation means including an upper belt means and a lower belt means, said upper and lower belt means for receiving said books therebetween, and means for biasing said lower belt means upwardly when a book is between said upper belt and said lower belt to press said book against said upper belt means.

2. The system of claim 1, including stacking means for selectively receiving certain of said books from said compensation means.

3. The system of claim 2, including a mail stream conveyor means for selectively receiving other of said books from said compensation means.

4. The system of claim 1, including a poor quality book conveyor means for selectively receiving certain of said books from said conveyor line.

5. The system of claim 2, including first selection means for selectively diverting certain of said books to said compensation means.

6. The system of claim 3, including second selection means for selectively diverting certain of said books from said compensation means to one of said stacking means or said mail stream conveyor means.

7. The system of claim 1, wherein said printer is disposed to print said books carried between said upper and lower belt means.

8. The system of claim 1, wherein said printer is a non-contact printer mounted upon said compensation means for printing a human readable address and bar coding on said books.

9. The system of claim 1, including a label head means located upstream of said compensation means for selectively applying a label on said books on said conveyor line.

10. The system of claim 1, including customizing means above and below said conveyor line upstream of said compensation means for selectively applying personalized information to said books in advance of said printer.

11. A signature customizing system of the type including a conveyor line, a plurality of feeders for selectively delivering and processing signatures on said conveyor line in groups of completed books of variable thickness, and a printer located adjacent said conveyor for printing information on said books, the system comprising:

compensation means operatively connected with said conveyor line for maintaining a constant distance between said printer and said books regardless of the variable thickness of said books in order to preserve the quality of printing on said books, including an upper belt means and a lower belt means, said upper and lower belt means receiving said books therebetween, said lower unit belt means being biased upwardly to press said books against said upper belt means, and said lower belt means being entrained about a series of parallel, spaced, reactive rollers.

12. A signature customizing system of the type including a conveyor line, a plurality of feeders for selectively delivering and processing signatures on said conveyor line in groups of completed books of variable thickness, and a printer located adjacent said conveyor for printing information on said books, the system comprising:

compensation means operatively connected with said conveyor line for maintaining a constant distance between said printer and said books regardless of the variable thickness of said books in order to preserve the quality of printing on said books, including an upper belt means and a lower belt means, said upper and lower belt means receiving said books therebetween, said lower unit belt means being biased upwardly to press said books against said upper belt means, and further including tensioning means for varying the tension of said upper belt means

* * * * *